US006397802B1

(12) United States Patent
Rutschmann et al.

(10) Patent No.: US 6,397,802 B1
(45) Date of Patent: Jun. 4, 2002

(54) MULTIPLE CYLINDER INTERNAL COMBUSTION ENGINE

(75) Inventors: Erwin Rutschmann, Tiefenbronn; Claus Bruestle, Ditzingen, both of (DE)

(73) Assignee: Dr. Ing. h.c.F. Porsche AG, Stuttgart (DE)

( * ) Notice: Subject to any disclaimer, the term of this patent is extended or adjusted under 35 U.S.C. 154(b) by 0 days.

(21) Appl. No.: 09/889,224

(22) PCT Filed: Oct. 24, 2000

(86) PCT No.: PCT/EP00/10450

§ 371 (c)(1),
(2), (4) Date: Jul. 13, 2001

(87) PCT Pub. No.: WO01/36793

PCT Pub. Date: May 25, 2001

(30) Foreign Application Priority Data

Nov. 13, 1999 (DE) ..... 199 54 689

(51) Int. Cl.[7] ..... F02D 13/02

(52) U.S. Cl. ..... 123/90.15; 123/90.17; 123/90.6

(58) Field of Search ..... 123/90.15, 90.16, 123/90.17, 90.6, 54.4, 54.7, 315

(56) References Cited

U.S. PATENT DOCUMENTS

| | | | | |
|---|---|---|---|---|
| 4,068,630 A | * | 1/1978 | Bennett et al. | 123/315 |
| 4,512,311 A | | 4/1985 | Sugiyama | 123/432 |
| 4,878,462 A | | 11/1989 | Kurisu et al. | 123/90.17 |
| 4,964,375 A | * | 10/1990 | Takeyama et al. | 123/315 |
| 5,074,260 A | * | 12/1991 | Yagi et al. | 123/90.16 |

FOREIGN PATENT DOCUMENTS

| | | |
|---|---|---|
| EP | 0319956 | 6/1989 |

* cited by examiner

*Primary Examiner*—Weilun Lo
(74) *Attorney, Agent, or Firm*—Crowell & Moring LLP

(57) ABSTRACT

A multi-cylinder internal combustion engine with at least one cylinder row is equipped with a cylinder head housing containing intake and exhaust valves that feed combustion air to the cylinders and release combustion exhaust gases through an exhaust system via control devices in dependence of the position of the crankshaft. Devices for generating differing exhaust valve lift progressions of at least two cylinders arranged in one cylinder row are incorporated to reduce overlapping opening phases of these exhaust valves. The intake valve and the exhaust valve of one of the two cylinders are themselves in an overlapping opening phase. Thereby, a uniform filling rate of the cylinders with new gas is achieved, particularly on a V-8 engine with a 90°-bent crankshaft.

9 Claims, 4 Drawing Sheets

MULTIPLE CYLINDER INTERNAL COMBUSTION ENGINE

BACKGROUND OF THE INVENTION

This application claims the priority of PCT International No. EP00/10450 filed Oct. 24, 2000 and German Patent Document 19954689.4, filed Nov. 13, 1999, the disclosures of which are expressly incorporated by reference herein.

The present invention relates to a multi-cylinder internal combustion engine with at least one cylinder row and a cylinder head housing containing intake and exhaust valves that feed combustion air to the cylinders and release combustion exhaust gases through an exhaust system via control devices in dependence of the position of the crankshaft.

In multi-cylinder internal combustion engines the exhaust gases produced during the combustion process are released to the outside with the aid of manifolds which are allocated to the individual cylinders and then flow together into a joint exhaust manifold pipe. In the case of a predetermined firing order, operating conditions can occur where the opening phases of the exhaust valves of two cylinders that are arranged in one cylinder row overlap. This condition is particularly critical when the intake and exhaust valves of the first cylinder in the firing sequence are still in the overlapping opening phase. During the opening of the exhaust valve of the cylinder that fires later and thus exhausts later, the higher-pressure exhaust gas can reach the cylinder area of the cylinder that exhausts sooner. A high degree of residual gas with negative consequences on the knock limit as well as an insufficient cylinder filling rate with new gas are the result.

The utilization of variable control times reinforces the distribution of the individual cylinders air intake, and does so even more with a larger adjustable range. The reduction in the air intake of the disadvantaged cylinders can lead to a reduction in the air intake particularly for a crank angle (KW) of less than 100°, which diminishes the desired torque increase considerably.

SUMMARY OF THE INVENTION

It is therefore an object of the present invention to eliminate and/or reduce such negative consequences and to achieve a uniform optimal cylinder filling rate across the entire cylinder row of the internal combustion engine.

This object has been achieved with the present invention by providing that apparatus (44') for generating differing exhaust valve lift progressions of at least two cylinders arranged in one cylinder row, leading to a reduction in the overlapping opening phases of these exhaust valves (28), where an intake valve (26) and an exhaust valve (28) of one of the at least two cylinders are in an overlapping opening phase.

By reducing the overlapping opening phases of the exhaust valves of cylinders that are arranged in one cylinder row, the exhaust lead thrust, which comes from the cylinder exhausting later and reaches the overlapping opening phase of the intake and exhaust valves of the cylinder exhausting sooner, is reduced. This results in a basically uniform new gas cylinder filling rate for all cylinders.

A reduction in the overlapping opening phases of exhaust valves that are allocated to the cylinders in one cylinder bank can easily be achieved by equipping the cams that are arranged on an exhaust cam shaft with different cam shapes.

A satisfactory bunching of the air intake curves for all cylinders across the entire r.p.m. range is created especially when the cylinders that are favored by the firing sequence are equipped with cams that have a smaller cam width than those cylinders where due to the firing sequence the exhaust lead thrust of the cylinder exhausting later in the cylinder row reaches the overlapping opening phase of the intake and exhaust valves of the cylinder exhausting sooner.

Optimization of the cylinders that are disadvantaged by the firing sequence is achieved when the narrower cam of the cylinder exhausting sooner has a cam width that is smaller by a crank angle of 10° to 20° per 1 mm valve lift.

Particularly on a V-8 engine with, for example, a 90° bend of the crankshaft, where the engine experiences good balancing of masses and moments, the gas exchange disadvantages occurring particularly with this type of engine can be largely compensated for with the reduction in overlapping opening phases of the exhaust valves.

The gas exchange disadvantages on such internal combustion engines are particularly noticeable when the 4-finger exhaust manifold that is flanged on the exhaust side of the two cylinder banks transitions into a joint exhaust manifold pipe after a short distance. This type of exhaust gas discharge is beneficial because this way primary catalytic converters can be used and only one pre-catalytic converter and one lambda probe must be integrated into the exhaust manifold pipe that is provided for each cylinder row. Due to the short exhaust manifold pipes, however, the risk arises that the majority of the exhaust lead thrust from the cylinder exhausting later ends up in the cylinder exhausting sooner. On a V-8 engine with such an exhaust discharge, the gas exchange disadvantages can thus be fully compensated for so that impact of variable control times can fully take effect across the entire r.p.m. range, achieving the desired ample torque progression.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
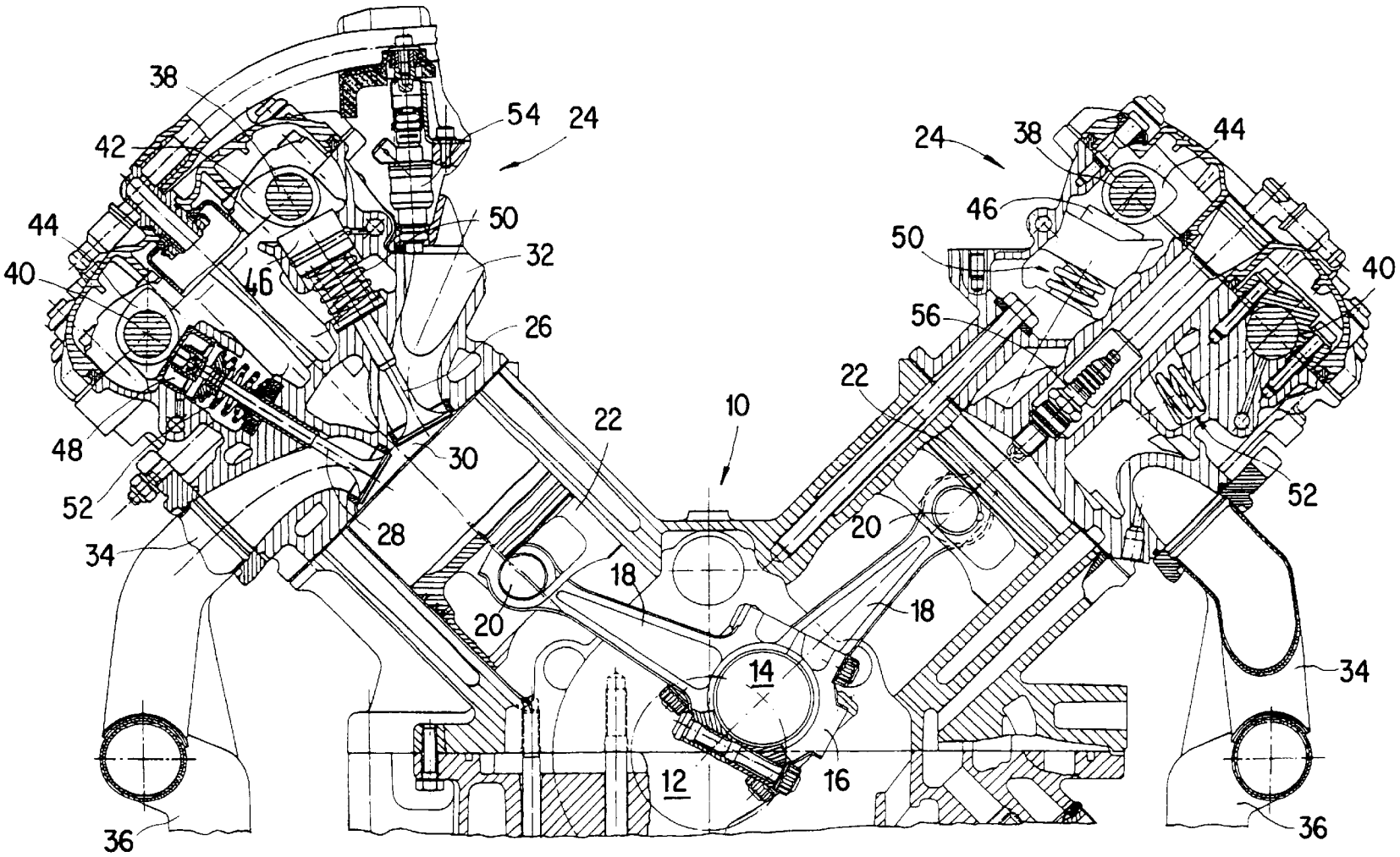
FIG. 1 is a cross-sectional view of a V-8 engine.
Figure 2:
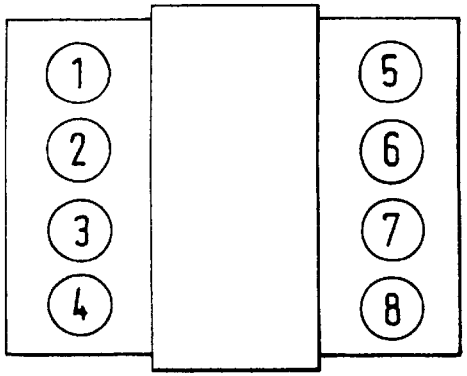
FIG. 2 is a schematic view of the two cylinder rows of a V-8 engine.

The internal combustion engine in the form of a V-8 engine is equipped with a crankshaft 12 that is arranged in a crankcase 10. The connecting rod bases 16, of which only one is shown, of the connecting rods 18 are screwed to the crankshaft journals 14, which are arranged in an offset manner by a crank angle of 90°; the con-rods are, in turn, connected via connecting rod eyes 20 with the eight pistons 22 that are arranged in the two cylinder rows.

The two cylinder heads 24, which are fastened on the crankcase 10, hold the necessary and familiar components for the 4-cycle combustion process, wherein the same components are used for all four cylinder that are arranged in one row. Each cylinder is equipped with two intake valves 26 and two exhaust valves 28, of which only one can be seen in FIG. 1. The intake valves 26 monitor or are associated with the intake ports 32 leading to the combustion chamber 30, while the exhaust valves 28 monitor or are associated with the exhaust ports 34 which also lead to the combustion chamber 30.

The four exhaust ports 34 that are flanged to each of the two cylinder rows, are depicted as 4-finger exhaust manifolds which flow into a joint exhaust pipe 36 after a short distance. The intake ports 32 located on the intake side are supplied with combustion air via an intake system in a known manner which need not be shown. Actuation of the intake and/or exhaust valves 26, 28 occurs with the aid of an intake cam shaft 38 and an exhaust cam shaft 40. The intake and exhaust cam shafts 38, 40, respectively, are equipped with four pairs of intake cams 42 and exhaust cams 44; the cylinder-specific special configuration of the cams will be described more in detail herein below.

The rotational motion of the intake and exhaust cam shafts 38, 40 is translated via cup tappets 46 and 48 in the form of cam followers into a lifting motion of the intake and exhaust valves 26, 28. Valve springs 50, 52, which are arranged in a coaxial manner to the valve stem of the intake and exhaust valves 26, 28, ensure among other things that the intake and exhaust valves 26, 28 safely close the intake and/or exhaust ports 32, 34 during the basic phase of the cams 46, 48. With the aid of injection valves 5, 4, fuel is injected into the intake ports 32 which is subjected to a combustion process with the help of an ignition device in the form of a spark plug 56 when opening the intake valve 26.

Figure 3:
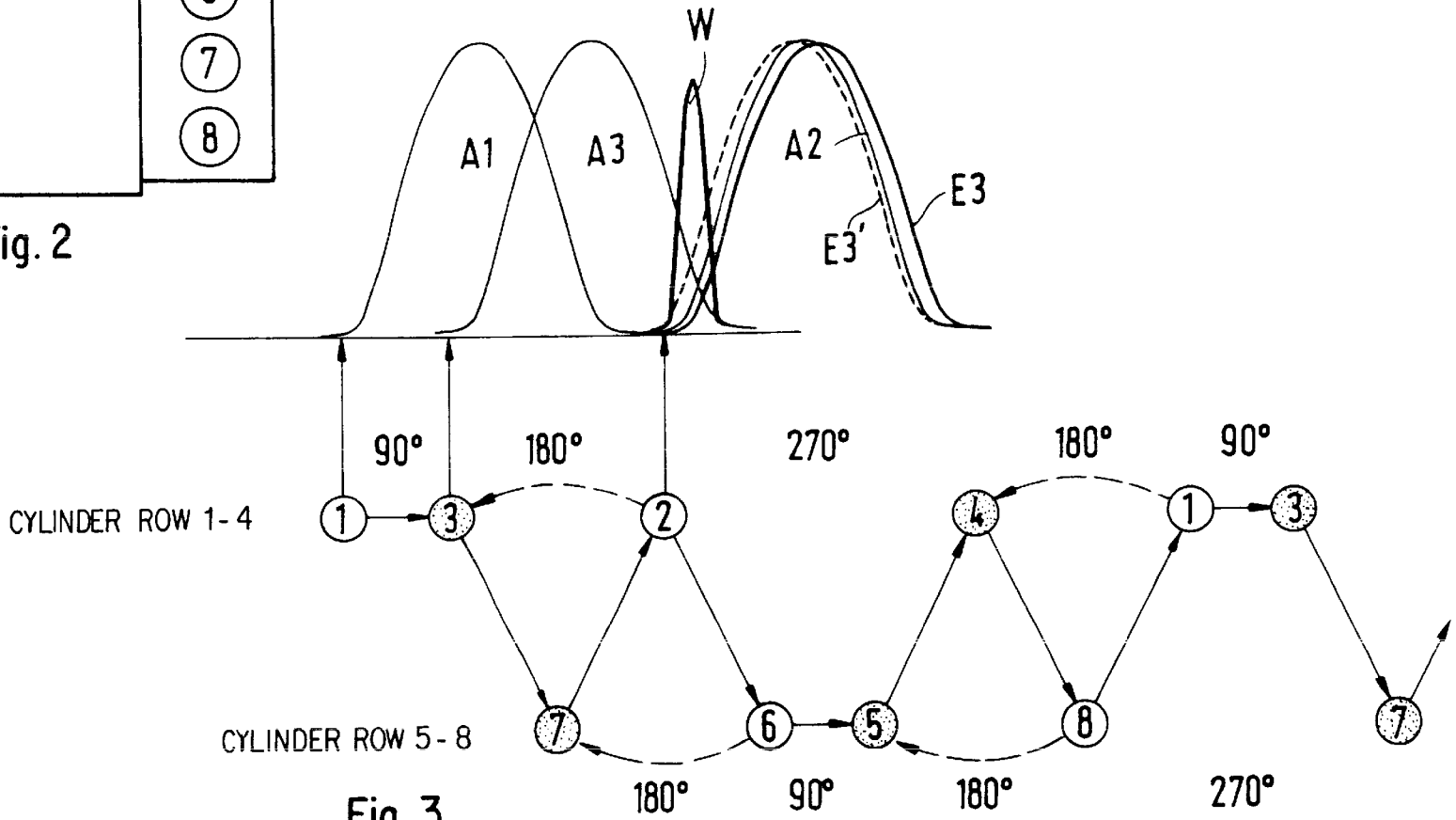
FIG. 3 is a diagram showing the firing sequence of a V-8 engine with a partial depiction of the gas exchange process of three neighboring cylinders.
Figure 4:
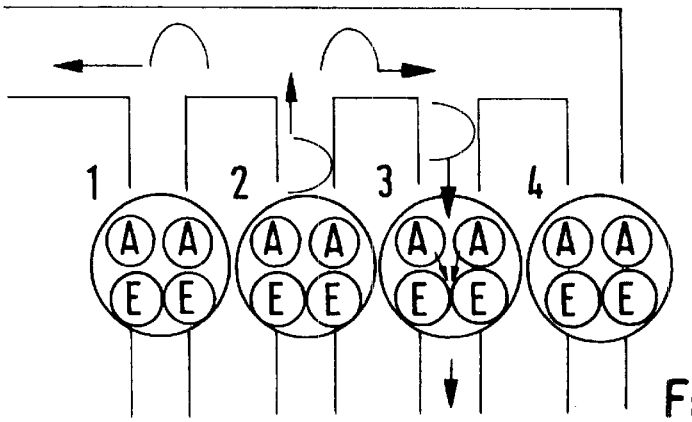
FIG. 4 is a schematic view of a cylinder bank.

FIG. 3 shows the firing sequence of the cylinders 1 through 4 and 5 through 8, which are arranged across the two cylinder rows. As the design on the bottom of FIG. 3 shows, the firing sequence is asymmetrical in relation to the two cylinder rows and has three different firing intervals per cylinder bank. Between cylinders 1 and 3 the firing interval is a crank angle of 90°, between cylinders 2 and 3 as well as between cylinders 1 and 4 the firing interval is a crank angle of 180°, and between cylinders 2 and 4 the crank angle is 270°. Similarly, the ignition point intervals in the second cylinder row 5 through 8 between cylinders 5 and 6 are a crank angle of 90°, between cylinder 6 and 7 as well as between cylinders 5 and 8 they are a crank angle of 180°, and between cylinders 7 and 8 they are a crank angle of 270°. As is explained more in detail with FIG. 3 and 4 in the following, the firing sequence 1-3-7-2-6-5-4-8 places cylinders 3 and 4 of the one cylinder bank and cylinders 5 and 7 of the other cylinder bank at a disadvantage compared to the remaining cylinders with regard to the new gas filling rate, called air intake in the following.

Based on the upper graph in FIG. 3, where the valve lifting curves of the exhaust valves 28 of the exhausting cylinders 1, 3 and 2 are shown at crank angles of 90° and 180°, the mutual outflow impairment of the cylinders 1 and 3 firing and/or exhausting at a crank angle of 90° can be seen. Far more severe with regard to the gas exchange however is the exhaust valve overlapping phase of the cylinders of one cylinder bank exhausting at a crank angle of 180°. As shown in the example of the valve lifting curves of the exhaust valves 28 of the cylinders 2 and 3, the exhaust lead thrust of the cylinder 2 that fires later and exhausts later at a crank angle of 180° ends up in the overlapping opening phase of the two intake and exhaust valves 26, 28 of the cylinder 3. This process, which is associated with the overlapping phases of the intake and exhaust valves and known as "internal exhaust gas recirculation," cannot be completely avoided on throttle-controlled spark ignition engines because a compromise between a satisfactory idle running behavior on the one hand and sufficient time opening cross-sections of the valves at high r.p.m. on the other hand must be found.

The exhaust lead thrust shown in the upper diagram of FIG. 3 as exhaust pressure wave W reduces the air intake A of the cylinder 3 that is already in the intake stroke. The utilization of variable valve control times, which can for example be implemented with the help of an axial cam shaft adjusting device, increases the distribution of the individual cylinders' air intake, and does so even more as the adjustable range is increased. This can lead to a reduction in air intake and a considerably reduced desired torque increase. The ability to adjust the intake valve opening times is shown as an example in the upper design of FIG. 3 with the dotted curve E3' for cylinder 3, which is shifted toward "early," compared to the valve opening curve E3.

In order to reduce the overlapping opening phases of the cylinders 1 and 3 and/or 1 and 4 exhausting at a crank angle of 180° within the cylinder row 1–4 and the cylinders 6 and 7 and/or 5 and 8 within the cylinder row 5–8, the disadvantaged cylinders 3, 4, 5, 7 with regard to their air intake are equipped with a larger cam width for the cams 44, which are arranged on the exhaust cam shaft 40.

Figure 5:
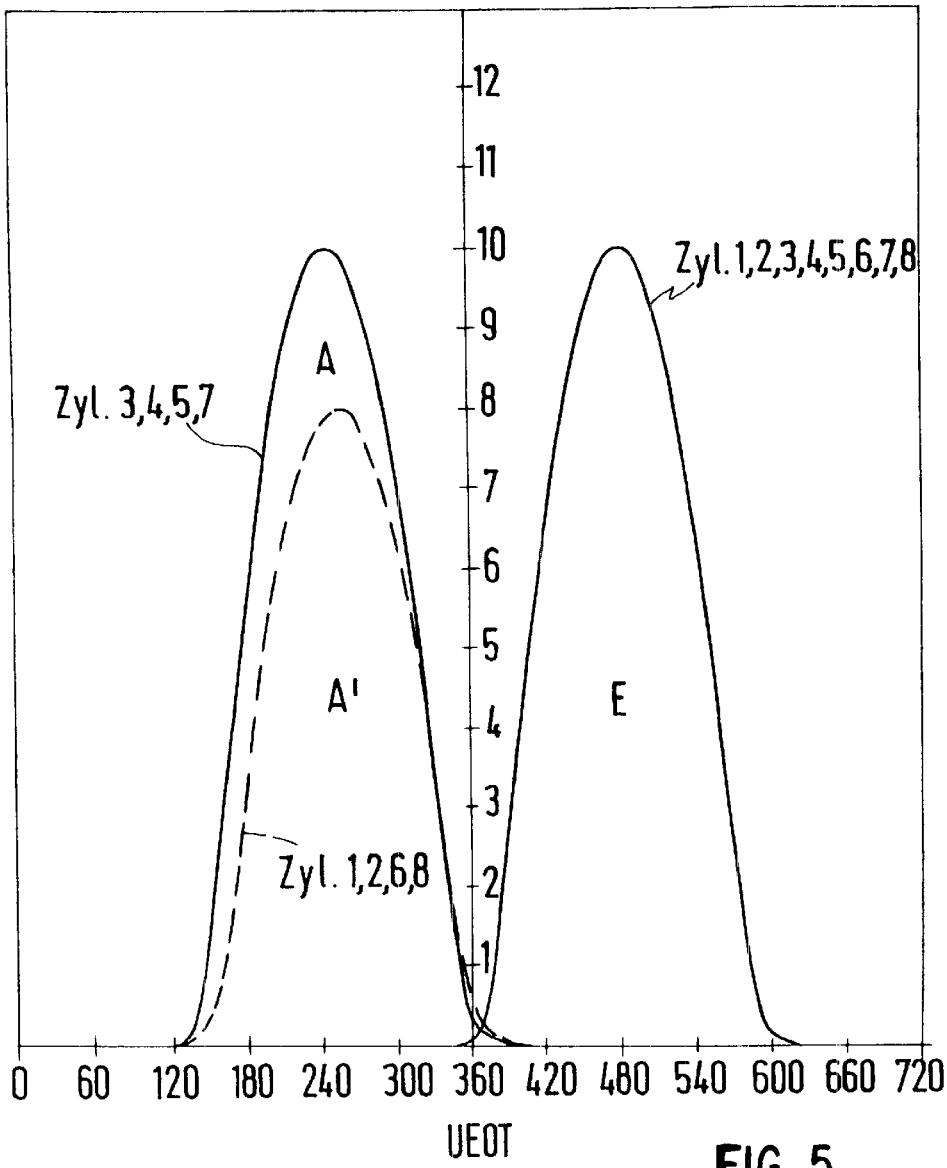
FIG. 5 is a graph of valve lifting curves.
Figure 6:
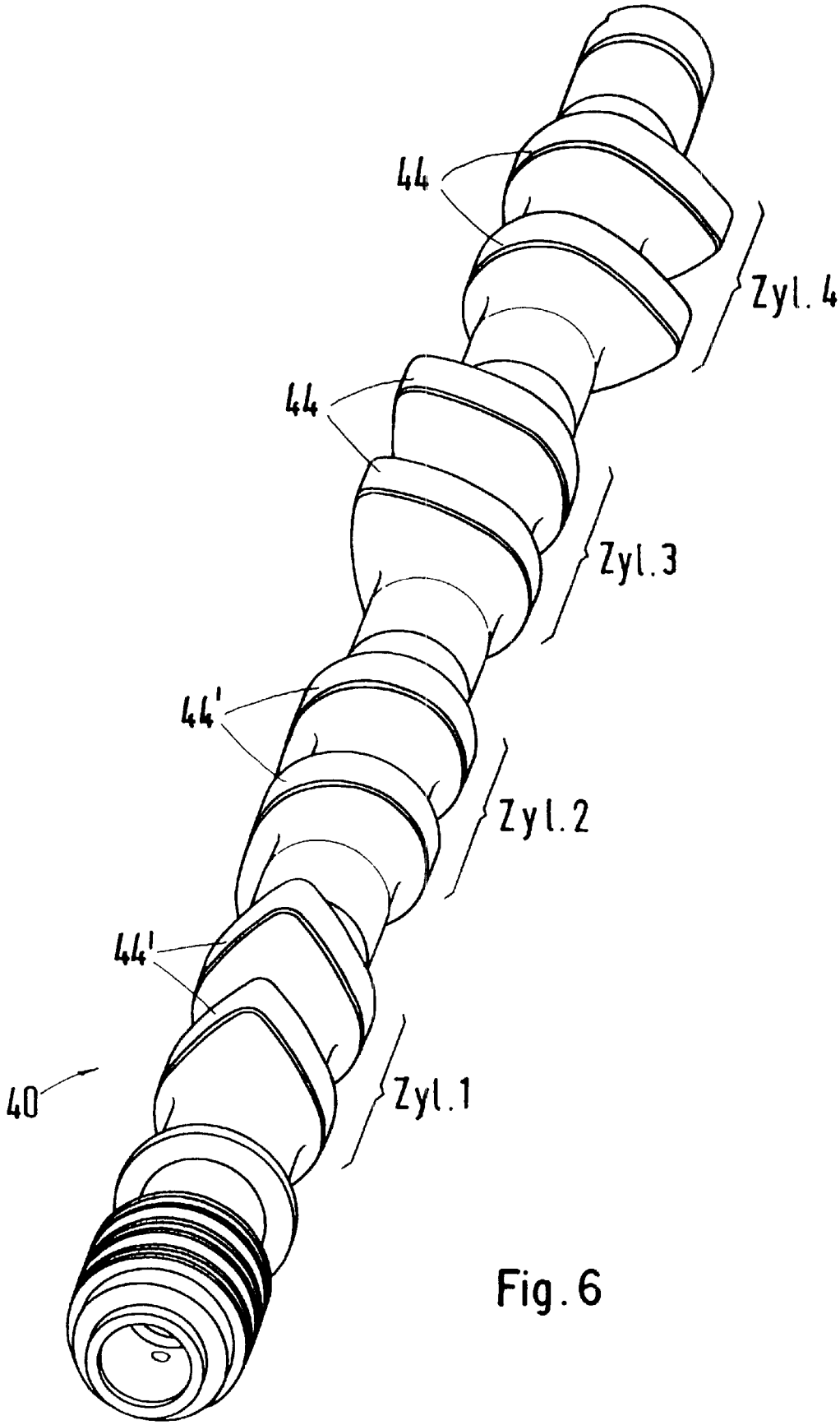
FIG. 6 is a perspective view of an exhaust cam shaft that is equipped with various cam widths in accordance with the present invention.

FIG. 5 depicts the valve lifting for the exhaust valves 28 of the cylinders 3, 4, 5, 7 with the left continuous line A, while the dotted smaller valve lifting curve A' is allocated to the exhaust valves 28 of the cylinders 1, 2, 6, 8. The narrower exhaust cams 44' for the cylinders 1, 2, 6, 8 reduce the overlapping opening phase of the exhaust valves 28 that are allocated to the cylinders 1, 2, 6, 8 compared to the exhaust valves 28 of the cylinders 3, 4, 5, 7, which open sooner by a crank angle of 180°.

Satisfactory bunching of the air intake lines, i.e. uniform air intake a per cylinder across the entire r.p.m. range, is achieved in particular when the narrower cams 44' have a cam width that is narrower by a crank angle of 10° to 20° per 1 mm valve stroke than the wide cams 44. Due to the narrower cam width for the cylinders 1, 2, 6, 8, the maximum valve lift of the exhaust valves 28 allocated to the cylinders is also reduced because of the specified cam outline, as shown in FIG. 5. The line E shown in FIG. 5 on the right side shows the course or curve of the valve lift of the intake valves 26, which is shown to be the same for all cylinders 1 through 8.

With such a cam shaft design, particularly for V-8 engines with a 90° bend of the crankshaft and a 4-in-1 exhaust manifold configuration, the impact of variable valve control times take effect across the entire r.p.m. range, which is associated with the desired full torque progression. The number of pre-catalytic converters and/or lambda probes makes a 4-in-1 exhaust manifold configuration with short manifold pipes preferable on V-8 engines. This number, however, makes the above-described disadvantageous effects regarding the new gas cylinder filling rate. The above-described cam shaft invention can be employed in a particularly effective manner.

Instead of cylinder-specific cams, other versions for reducing the overlapping opening phases of exhaust valves on multi-cylinder internal combustion engines are also contemplated. With the aid of fully variable valve controls, such as the purely mechanical fully variable valve drive, the mechanical/hydraulic fully variable valve drive and the electromechanical valve drive, the above-described inventive concept can also be implemented.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Multi-cylinder internal combustion engine with at least one cylinder row and a cylinder head housing containing intake and exhaust valves that feed combustion air to the cylinders and release combustion exhaust gases through an exhaust system via control devices in dependence of the position of the crankshaft, wherein comprising an apparatus for generating differing exhaust valve lift progressions of at least two cylinders arranged in one cylinder row, leading to a reduction in the overlapping opening phases of these exhaust valves, where an intake valve and an exhaust valve of one of the at least two cylinders are in an overlapping opening phase.

2. Multi-cylinder internal combustion engine in accordance with claim 1, wherein the intake valve and the exhaust valve are actuated via a respective cam shaft and cam shaft follower, and the cams arranged on the exhaust cam shaft have different cam configuration.

3. Multi-cylinder internal combustion engine in accordance with claim 1, wherein the cams arranged on the exhaust cam shaft have different cam widths.

4. Multi-cylinder internal combustion engine in accordance with claim 3, wherein at a 1 mm valve lift at least one of the cams having different cam widths has a cam width that is narrower by 10° to 20° than that of the other cams having different cam widths.

5. Multi-cylinder internal combustion engine in accordance with claim 1, wherein the internal combustion engine is a V-8 engine equipped with two cylinder rows and a crankshaft with a 90° bend.

6. Multi-cylinder internal combustion engine in accordance with claim 5, wherein the exhaust side of each of the two cylinder rows is provided with a four-finger exhaust manifold, respectively, which flows into a joint exhaust pipe.

7. Multi-cylinder internal combustion engine in according to claim 6, wherein the intake valve and the exhaust valve are actuated via a respective cam shaft and cam shaft follower, and the cams arranged on the exhaust cam shaft have different cam configuration.

8. Multi-cylinder internal combustion engine according to claim 7, wherein the cams that are arranged on the exhaust cam shaft have different cam widths.

9. Multi-cylinder internal combustion engine according to claim 8, wherein at a 1 mm valve lift at least one of the cams having different cam widths has a cam width that is narrower by 10° to 20° than that of the other cams having different cam widths.

* * * * *